US011302295B2

(12) United States Patent
Meehan

(10) Patent No.: US 11,302,295 B2
(45) Date of Patent: Apr. 12, 2022

(54) TUNING GUIDE

(71) Applicant: BD Performing Arts, Concord, CA (US)

(72) Inventor: John Meehan, Concord, CA (US)

( * ) Notice: Subject to any disclaimer, the term of this patent is extended or adjusted under 35 U.S.C. 154(b) by 0 days.

(21) Appl. No.: 15/413,138

(22) Filed: Jan. 23, 2017

(65) Prior Publication Data

US 2017/0213528 A1 Jul. 27, 2017

Related U.S. Application Data

(60) Provisional application No. 62/281,653, filed on Jan. 21, 2016.

(51) Int. Cl.
*G10D 9/01* (2020.01)
*G10D 7/10* (2006.01)

(52) U.S. Cl.
CPC ..... *G10D 9/01* (2020.02); *G10D 7/10* (2013.01)

(58) Field of Classification Search
CPC ..... G10D 9/005; G10D 7/10; G10D 9/01
USPC ..... 84/396
See application file for complete search history.

(56) References Cited

U.S. PATENT DOCUMENTS 2,990,744 A * 7/1961 Brilhart ..... G10D 7/10 84/388
4,276,804 A * 7/1981 Holland ..... G10D 9/005 84/394
4,909,126 A * 3/1990 Skinn ..... G10G 7/02 84/454
5,824,929 A 10/1998 Freeland
7,659,466 B1 2/2010 Jang
2007/0163424 A1 * 7/2007 Mintz ..... G10D 13/06 84/422.3
2015/0047493 A1 * 2/2015 Leadbetter ..... G10H 1/44 84/454

OTHER PUBLICATIONS

Snow, A Conduct A Conductor's Guide ts Guide to Wind Instrument Deficiencies: A Pr o Wind Instrument Deficiencies: A Practical Addendum to the Undergraduate Conducting Text, The University of Southern Mississippi, The Aquila Digital Community, Dissertations. 1344. (Year: 2006).*

International Search Report and Written Opinion in corresponding International Application No. PCT/US2017/014614. (dated Apr. 6, 2017).

* cited by examiner

*Primary Examiner* — Jianchun Qin
(74) *Attorney, Agent, or Firm* — Brian Beverly; Beeson Skinner Beverly, LLP

(57) ABSTRACT

Disclosed is a tuning guide for tuning a brass musical instrument having a tuning slide. The tuning guide includes (1) visual markings provided along one arm of the tuning slide indicating a plurality of tuning positions of the tuning slide and (2) a tuning log for logging a tuning history specific to both the instrument and a particular player of the instrument. The tuning log includes a plurality of tuning records, each tuning record including (i) one or more conditions fields, each conditions field for recording an environmental condition and (ii) a tuning position field for specifying a tuning position at which the instrument is properly tuned under the environmental conditions recorded in the one or more conditions fields.

18 Claims, 2 Drawing Sheets

TUNING GUIDE

CROSS-REFERENCE TO RELATED APPLICATIONS

This application claims the benefit of U.S. Provisional Application No. 62/281,653 filed Jan. 21, 2016.

BACKGROUND

Field of the Invention

This invention relates to musical instruments and particularly to tuning guides for brass musical instruments.

Discussion of the Prior Art

Accurate tuning of brass musical instruments is affected by temperature and humidity and varies according to the embouchure of the performer playing the instrument. Tuning of a brass musical instrument is accomplished by adjusting the length that a tuning slide extends from the instrument and is based on the performer's experience with a particular instrument under similar environmental conditions.

The tuning process generally involves placing an electronic tuner in front of the instrument and then playing a certain note on the instrument. The tuning slide is then pushed in or pulled out of the instrument based on whether the electronic tuner identifies the note played as being sharp or flat. To tune a large ensemble of brass instruments, such as in a marching band, an instructor or conductor typically must repeat this electronic tuning process several times in order to assist each performer in tuning his or her instrument. This can be incredibly time intensive and cumbersome, particularly during travel or in competition, when a brass ensemble must hastily move from one environment to another.

DETAILED DESCRIPTION OF THE ILLUSTRATED EMBODIMENT

Figure 1:
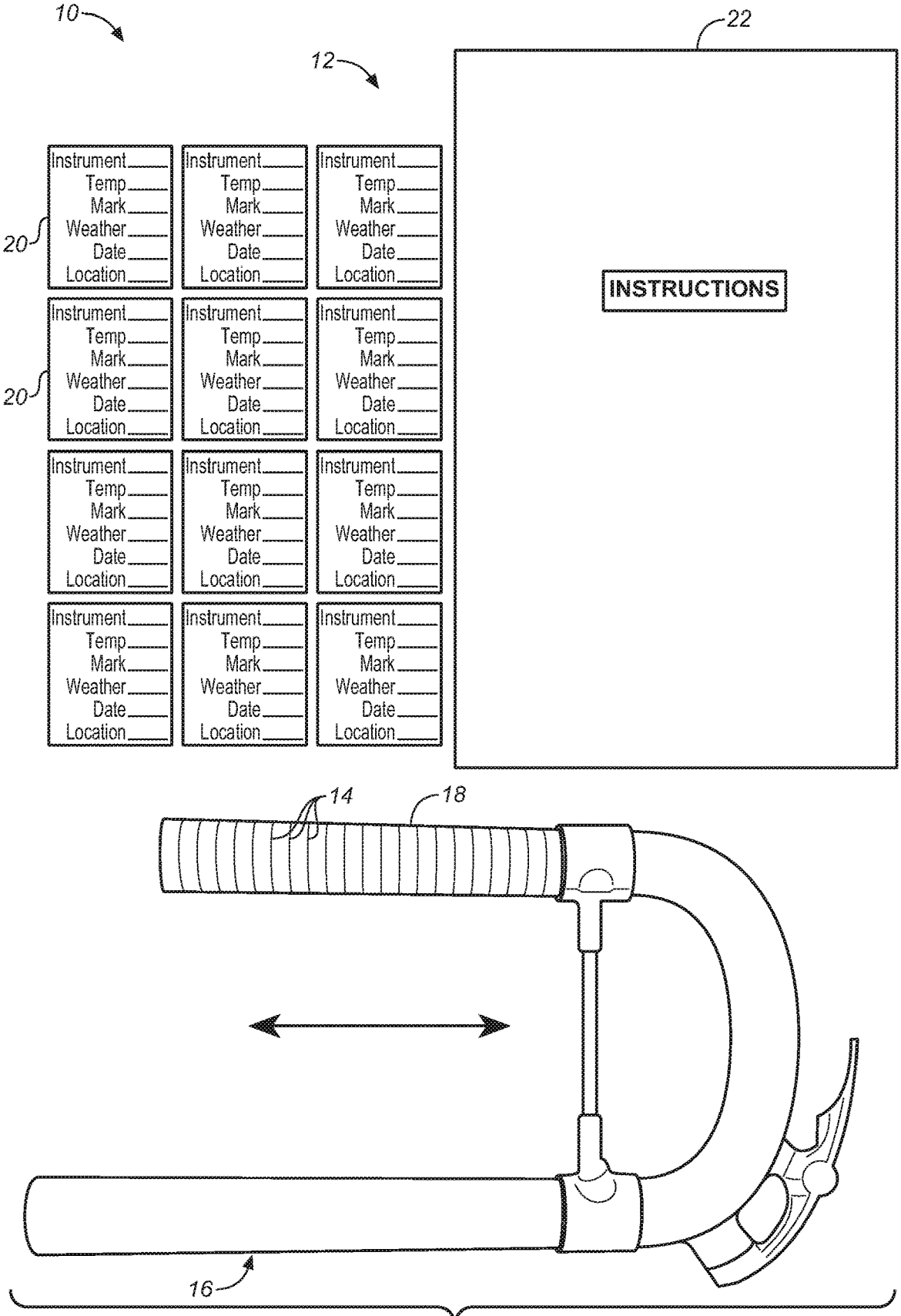
FIG. 1 is a schematic representation of a tuning guide according to the invention.

A tuning guide for a brass instrument, referred to generally at numeral 10 in FIG. 1, comprises a tuning log 12 and tuning marks 14 provided along one arm 18 of the tuning slide 16 of a brass instrument, usually at ⅛" intervals.

If the tuning slide 16 is fully inserted into the instrument and then pulled out, the first mark seen is generally understood to be mark "1," the second, mark "2," and so forth. In the illustrated embodiment, there are 21 marks, not counting the end of the arm, however the total number of marks will vary depending on the instrument.

The tuning log 12 comprises a plurality of tuning records 20 and a set of instructions 22 on how to use the tuning guide. Each record 20 contains a space for entering data regarding (1) the instrument being tuned, (2) the ambient temperature when the instrument is tuned, (3) the mark showing on the tuning slide 16 at which the instrument is found to be properly tuned, (4) the weather when the instrument is tuned, (5) the date, and (6) the location. In one embodiment, information identifying the instrument is entered a single time at the top of the tuning record 12 rather than multiple times in each of the individual records. In another embodiment, a space is provided for entering the humidity instead of or in addition to the weather.

Records 20 are used to accumulate a tuning history of what mark 14 the tuning slide 16 is set at when the instrument is tuned under particular temperature and weather, particularly humidity, conditions. For example, at 72° F. with 40% humidity, the tuning slide 16 on a trumpet could be set at mark 4. However, among a group of performing musicians, such as in a marching band, the tuning slide 16 for one performer may be set at a different mark than it is set for another performer. This may be due to differences in musicians' embouchures and to differences between the particular instruments being played. If the humidity were to change from 40% to 80%, assuming the same temperature, the tuning slides will need to be adjusted for each instrument.

Figure 2:
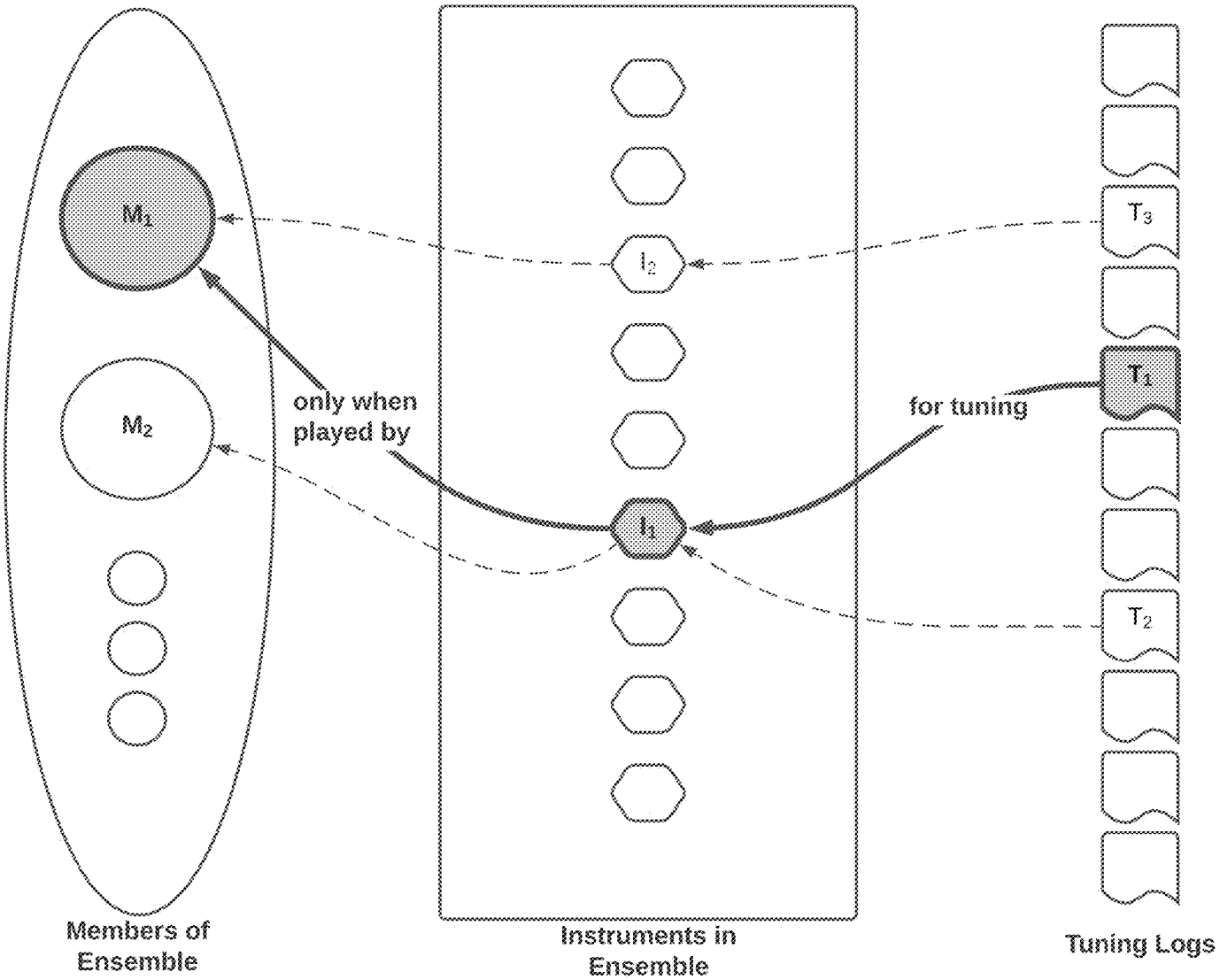
FIG. 2 is a schematic representation of the relationship between the tuning logs, instruments and members of an ensemble according to the invention.

Accordingly, as indicated by the solid lines in FIG. 2, each tuning log T is uniquely associated with one of the instruments 1 only for when being played by a particular member M of the ensemble. Thus, tuning log $T_1$ is uniquely associated with instrument $I_1$ only for when it is being played by member $M_1$ of the ensemble. As indicated by the dotted lines, tuning log $T_2$ is uniquely associated with instrument $I_1$ only if it is being played by member $M_2$, and tuning log $T_3$ is uniquely with instrument $I_2$ only for when it is being played by member $M_1$.

By recording the temperature and humidity, or other environmental conditions, existing on multiple incidents when the instrument is tuned, a unique historical tuning record is thus collected for each musician with respect to a particular instrument played by that musician. This historical record can save valuable time when it is necessary to tune all the instruments in an ensemble because the tuning slide 16 can be set at a particular mark 14 at which it was previously set when the same environmental conditions were experienced by making reference to the historical record. If the precise conditions occurring at the time the instrument is being tuned are not found in the historical record, the correct position of the tuning slide 16 can be estimated based on the most closely similar conditions noted in the historical record.

The tuning slide 16 will tune the instrument when pulled out until the desired mark 14 shows. The instrument can also be fine-tuned to a position between two adjacent marks, e.g., mark 2.5, by pulling the tuning slide 16 out to the larger of the two adjacent marks and then pushing the tuning slide 16 back in to the desired fractional mark as shown by the arrows in FIG. 1. For example, if it is desired to tune the instrument by moving the tuning guide 16 to the 2.5 mark, the tuning guide 16 should be pulled out to mark 3 and then pushed back in to the 2.5 position.

A tuning guide 10 can save a considerable amount of time when it is necessary to tune all the instruments in a brass ensemble, such as a marching band. Instead of each instrument being individually tuned, perhaps in reference to an electronic tuner, all the instruments in the ensemble can be tuned quickly and accurately by adjusting the tuning slide 16 to the mark 14 as shown in each tuning record 20 for the same or similar environmental conditions.

Another advantage to the invention is that an instrument, or all the instruments in an ensemble, can be "pre-tuned" for a particular environment while being in another environment. For example, if an ensemble is outside a venue where the temperature is 88° F. with 70% humidity, but will shortly be performing in the venue where the temperature is 72° F. and 40% humidity, the tuning slides 16 can be set at the appropriate mark 14 for the venue rather than tuning the instruments outside and then finding it necessary to retune the instruments once inside the venue.

There have thus been described and illustrated certain embodiments of a tuning guide according to the invention. Although the present invention has been described and illustrated in detail, it should be clearly understood that the disclosure is illustrative only and is not to be taken as limiting.

I claim:

1. A tuning system for tuning a plurality of brass musical instruments in an ensemble, the tuning system comprising:

a tuning slide on each of said brass musical instruments, each tuning slide having a plurality of visual markings along one arm thereof indicating a plurality of tuning positions, and a plurality of tuning logs, each tuning log associated with one of the instruments only for when being played by a particular member of the ensemble, each tuning log including a plurality of tuning records, each tuning record including:

one or more conditions fields each configured to record indicia regarding an atmospheric condition experienced by all members of the ensemble during a performance, and a tuning position field configured to record indicia regarding one of said plurality of tuning positions at which the associated instrument is properly tuned for when being played by said particular member under the recorded one or more atmospheric conditions;

wherein said member is enabled to tune one of said brass musical instruments by positioning the tuning slide of the instrument at the tuning position recorded in the associated tuning log for said one or more atmospheric conditions in preparation for a performance by the ensemble.

2. The tuning system of claim 1, wherein the plurality of visual markings comprises interval markings spaced at regular intervals along said one arm of said tuning slide.

3. The tuning system of claim 2, wherein the visual markings are spaced at ⅛" intervals.

4. The tuning system of claim 1, wherein the one or more condition fields include a temperature field configured to record temperature information.

5. The tuning system of claim 1, wherein the one or more condition fields include a humidity field configured to record humidity information.

6. The tuning system of claim 1, wherein the one or more conditions fields include a weather field configured to record weather information.

7. The tuning system of claim 1, wherein the visual markings are numerical markings.

8. The tuning system of claim 1 wherein:

each tuning slide comprises an elongated tube having an axial length, and each of the plurality of visual markings extends perpendicularly relative to the length of each tuning slide.

9. The tuning system of claim 1 wherein:

each of the plurality of visual markings is fixed in position relative to each tuning slide.

10. The tuning system of claim 1 wherein:

the tuning position at which one of said instruments is properly tuned for playing by the associated player of the instrument depends on the embouchure of the associated player.

11. A method of tuning a plurality of brass musical instruments in an ensemble, the method comprising:

recording indicia in one of one or more tuning records in each of a plurality of tuning logs by each of the members of an ensemble, each tuning log uniquely associated with one of the instruments in the ensemble only for when being played by a particular member of the ensemble, each tuning record including fields for recording indicia regarding:

(i) one or more atmospheric conditions experienced by all members of the ensemble during a performance, and (ii) a tuning position at which the associated instrument is properly tuned for when being played by said particular member under said one or more atmospheric conditions, the tuning position being one of a plurality of positions of a tuning slide of said instrument indicated by a plurality of visual markings provided along one arm of said tuning slide, selecting from each tuning log, a tuning record that includes one or more previously recorded atmospheric conditions that approximate the atmospheric conditions of an environment in which the instruments are to be played, and tuning each of the plurality of instruments by said particular player by placing the tuning slide of said instrument in the tuning position recorded in the tuning record selected from the tuning log uniquely associated with said instrument.

12. The method of tuning a plurality of brass musical instruments in an ensemble of claim 11, the method further comprising:

distributing one or more of said plurality of tuning logs to each member of the ensemble.

13. A method of tuning a plurality of brass musical instruments in an ensemble, the method comprising:

selecting a tuning record from each of a plurality of tuning logs, each tuning log associated with one of the brass musical instruments in the ensemble and with a particular player of said instrument, each tuning record including one or more conditions fields and a tuning position field, each of the conditions fields configured to record indicia indicating an atmospheric condition that is to be mutually experienced by all of the players during an ensemble performance and the tuning position field configured to record indicia indicating a tuning position at which the associated instrument is properly tuned under the one or more atmospheric conditions recorded in the one or more conditions fields, and tuning each of the plurality of instruments by the particular player associated therewith by placing a tuning slide of said instrument in the tuning position recorded in the tuning record selected from the tuning log associated with said instrument.

14. The tuning method of claim 13 wherein the selecting step further comprises:

selecting a record from each tuning log in which is recorded one or more atmospheric conditions that approximate the atmospheric conditions of an environment in which the instruments are to be played during a performance by the ensemble.

15. A tuning system for tuning each of a plurality of brass musical instruments in an ensemble of a plurality of players of the instruments, the tuning system comprising:

each of said plurality of brass musical instruments having a plurality of visual markings extending axially along the tuning slide thereof, each of said plurality of visual markings indicating one of a plurality of tuning positions of the tuning slide, and a plurality of tuning logs, each of said plurality of tuning logs uniquely associated with one of the plurality of brass musical instruments only for when being played by one of the plurality of players of the ensemble, each of said plurality of tuning logs including one or more tuning records, each tuning record including:

(i) one or more conditions fields, each of said conditions fields configured to record a mutually experienced atmospheric condition, said mutually experienced atmospheric condition experienced by each of the plurality of players during an ensemble performance by all of the plurality of players, and (ii) a tuning position field configured to record a tuning position indicative of the position of the tuning slide of the associated instrument at which said instrument is properly tuned under said mutually experienced atmospheric condition;

wherein said one of the plurality of players is enabled to tune one of said brass musical instruments by positioning the tuning slide of the instrument at the tuning position recorded in the associated tuning log for said one or more atmospheric conditions in preparation for a performance by the ensemble.

16. A method of tuning each of a plurality of brass musical instruments in an ensemble of a plurality of players of the instruments, the method comprising:

recording one or more atmospheric conditions in one or more condition fields in one of one or more tuning records in each of a plurality of tuning logs, each of said tuning logs uniquely associated only with one instrument of the plurality of brass musical instruments only for when being played by one of the plurality of players, and recording a tuning position in a tuning position field in each of said one or more tuning records, said recorded tuning position indicating the position of the tuning slide of the instrument associated with said tuning record at which said instrument is properly tuned for when being played by the associated player under said one or more atmospheric conditions, positioning the tuning slide of each of the plurality of instruments at the tuning position recorded in the associated tuning log for said one or more atmospheric conditions in preparation for a performance by the ensemble.

17. The method of tuning of claim 16 wherein:

said tuning position is indicated by one of a plurality of visual markings on the tuning slide of the instrument associated with the tuning log.

18. A method of tuning a plurality of brass musical instruments in an ensemble, the method comprising:

recording, in one of one or more tuning records in each of a plurality of tuning logs, indicia regarding one or more atmospheric conditions experienced by all members of the ensemble during a performance, each tuning log uniquely associated with one of the instruments in the ensemble only for when being played by a particular member of the ensemble, and recording in one of said one or more tuning records a tuning position at which the associated instrument is properly tuned when played by said particular member under said one or more atmospheric conditions, wherein the tuning position is one of a plurality of positions of a tuning slide of said instrument indicated by a plurality of visual markings provided along one arm of said tuning slide; and positioning the tuning slide of each of the plurality of instruments at the tuning position recorded in the associated tuning log for said one or more atmospheric conditions in preparation for a performance by the ensemble.

* * * * *